US005913431A

United States Patent [19]

Rathjen

[11] Patent Number: 5,913,431

[45] Date of Patent: Jun. 22, 1999

[54] BOW CRADLE

[76] Inventor: Donald J. Rathjen, 105 Bittersweet, O'Fallon, Mo. 63366

[21] Appl. No.: 08/921,558

[22] Filed: Sep. 2, 1997

[51] Int. Cl.[6] ..... A47F 7/00

[52] U.S. Cl. ..... 211/85.7; D6/552; 211/87.01

[58] Field of Search ..... 211/85.7, 13.1, 211/87.01, 14, 99, 70.5; D6/552; 224/916

[56] References Cited

U.S. PATENT DOCUMENTS

| | | | |
|---|---|---|---|
| D. 268,309 | 3/1983 | Wall | D6/552 |
| 2,745,558 | 5/1956 | Greenspan | 211/60 |
| 3,082,878 | 3/1963 | Thomas | 211/60 |
| 4,108,312 | 8/1978 | Craven | 211/85.7 |
| 4,450,967 | 5/1984 | Castro | 211/13 |
| 4,763,797 | 8/1988 | Egan | 211/70.5 |
| 5,048,504 | 9/1991 | Ballard | 124/86 |
| 5,145,074 | 9/1992 | Miley | 211/87.01 X |
| 5,595,333 | 1/1997 | Boston | 211/64 X |
| 5,725,106 | 3/1998 | Wilson | 211/85.7 X |
| 5,791,610 | 8/1998 | Sanchez | 224/916 X |

*Primary Examiner*—Robert W. Gibson, Jr.

*Attorney, Agent, or Firm*—Patent & Trademark Services; Thomas Zack; Joseph H. McGlynn

[57] ABSTRACT

A bow display and storage device having two spaced bow engaging mounts that are pivotally joined to a support backing. By changing the orientation of the mounts with respect to the backing and the curvature of a cradled bow, different bows with different arcuate curvatures can be accommodated. Upper mount recesses shaped and sized to the engaging bow's sections are used to cradle the bow and vertically support it against the support backing. An optional raised lip may be added to the recesses and the mounts may be held to the backing by screw fasteners inserted from the back of the support backing and extending through it to engage the bow engaging mounts.

4 Claims, 1 Drawing Sheet

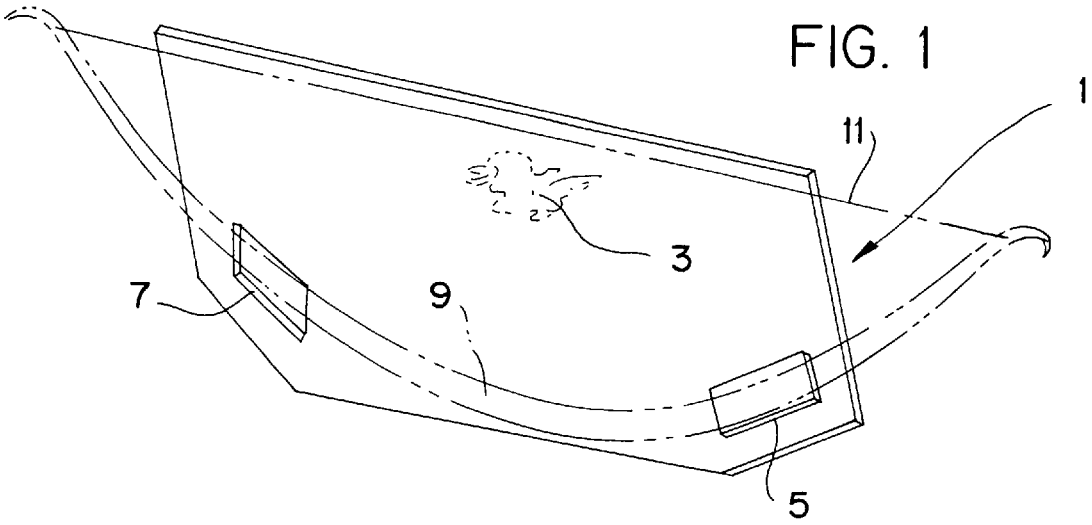
FIG. 1
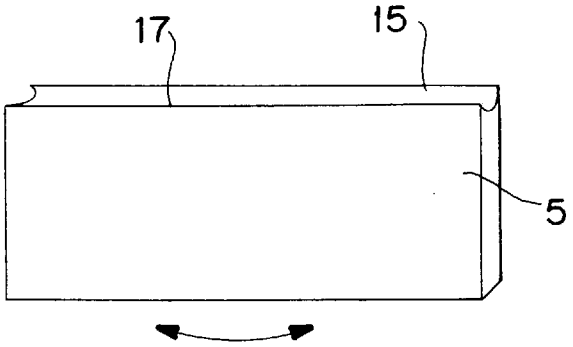
FIG. 2
FIG. 3
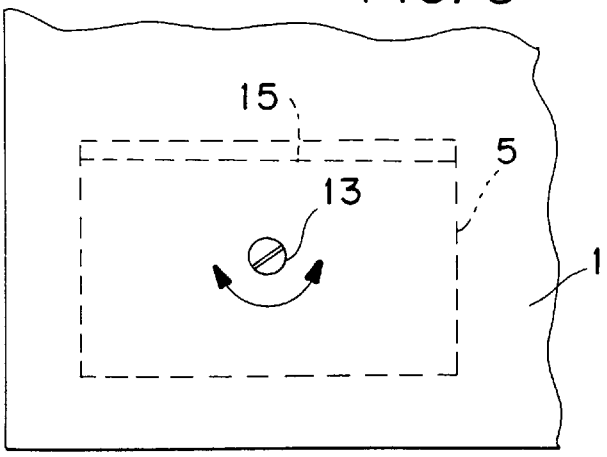
FIG. 4
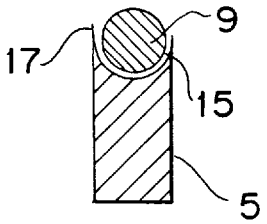

BOW CRADLE

BACKGROUND OF THE INVENTION

Archers, whether they use compound, long or other types of bows, have long sought to find an appropriate display and storage devices for their bows. In some cases two spaced nails, pins, or dowels protruding from a planar backing, such as a wooden plaque or shield, were used for this purpose. Other have used existing wall racks to hang and display the bow. For example, gun racks have been used for this purpose. While these and other bow display and storage devices may work to a degree, they have neglected to take into consideration variations in the bow's arcuate angle where it engages the bow supports to provide a bow mount that is contoured to that arcuate angle.

The present invention seeks to address these consideration by providing for a bow cradle or bow mount wherein a planar mounting surface has two spaced bow engaging mounts whose angular bow engaging surface may be changed to accommodate different bows having different arcuate bow variations as described herein.

DESCRIPTION OF THE PRIOR ART

Different types of storage and display supports have been used for archery equipment. For example, in U.S. Pat. No. 2,745,558 to Greenspan a wall mounted frame has a detachable arrow rack and a plurality of spaced upper pegs for supporting one or more hanging bows.

In the Thomas patent (U.S. Pat. No. 3,082,878) the displayed bow or bows are vertically disposed and cradled in upper and lower holding apertures and entrance slots.

The Castro reference (U.S. Pat. No. 4,450,967) mounts its bow horizontally to the base of a storage racks with a pair of spaced support pegs extending forward of an arrow storage frame.

In U.S. Pat. No. 5,048,504 to Ballard the archery support stand has a lower pivotally mounted block with an arcuate upper face with an upper lock pin to engage the bow's arcuate surface both below and above it. The present invention differs from this and the known prior art by providing for a bow storage and display rack having two spaced bow surface engaging mounts joined to a planar mounting surface whose angular engaging surface may be varied to accommodate different different bows with different arcuate angles as more further set forth in this specification.

SUMMARY OF THE INVENTION

This invention relates to a bow display and storage device. Two spaced bow mounts are pivotally attached to a vertically disposed planar frame mount to cradle engaging surfaces of the bow. Arcuate variations in different bows can be accommodated for by changing the pivotal mount of the mounts with respect to the frame mount.

It is the primary object of the present invention to provide for an improved bow storage and display device.

Another object is to provide for such a device where arcuate variation in the bow's engaging surface can be provided for by changing the angular relationship between two spaced bow mounts.

These and other objects and advantages of the present invention will become apparent to readers from a consideration of the ensuing description and the accompanying drawings.

BRIEF DESCRIPTION OF THE DRAWINGS

FIG. 1 is a front perspective view of the invention's preferred embodiment.

FIG. 2 is a front view of one of the FIG. 1 mounts.

FIG. 3 shows a back view of the FIG. 2 mount.

FIG. 4 shows a side cross sectional view of the mount with a bow cradled therein.

DESCRIPTION OF THE PREFERRED EMBODIMENT

FIG. 1 is a front perspective view of the invention's preferred embodiment. A generally flat planar backing mount 1 is vertically supported by conventional wall fasteners (not shown) above a floor. This mount may assume many different sizes and shapes such as the six sided shape shown. It may be made of any conventional material used for display racks such as stained and sealed wooden pine or oak material. Indicia 3 descriptive of an animal or other object, name, etc. may be imprinted on the mount's surface or may form by raised surfaces thereon.

Two spaced substantially identical bow mounts 5 and 7 are pivotally joined to the front planar surface of mount backing 1 and extend outwardly therefrom. These mounts act to engage and cradle the arcuate shaped bow 9 shown in dotted line format. They may extend several inches outwardly from the backing planar surface to slight tilt the bows' ends backward against the backing surface. The bow's string 11, as in a conventional long bow, used to engage an arrow's end to be propelled through the air, is shown extending between the two bow ends in a taut condition while the bow's wooden, fiberglass or other material body portion is mounted and held near its two ends by the two spaced mounts.

Variations in the arcuate curvature of different bow's can be accommodated for by changing the orientations of the supporting pivotally mounts with respect to the supporting backing mount 1.

FIG. 2 is a front view of one of the FIG. 1 mounts 5. The other substantially identical mount 7 is the mirror image and would perform accordingly. Extending through approximately the center of the mount 5 is a pivot connection which joins the mount to the backing 1. In this figure the pivotal connection is formed by a wood screw which extends from the back of the backing 1 into the mount 5 but not through the mount's exposed frontal surface.

FIG. 3 shows a back view of the FIG. 2 mount and depicts the head of wood screw 13 screwed into the back of the backing 1. The screw extends through the mount backing 1 until it engages the mount 5 (shown in dotted line format) to pivotally joined it on the backing's other or front side. Other types of pivotal connections besides screws, such a nails, pins, pegs, etc. could also be used to pivotally mount the mounts 5 and 7 to the planar backing 1.

FIG. 4 shows a side cross sectional view of the mount 5 with the bow 9 cradled therein. Spaced mount 7 would similarly engage the same bow to vertically support it on the backing 1. At the mounts' upper bow engaging surfaces are arcuate shaped surface notches 15 whose cross sectional shapes are similar to the arcuate or rounded engaging shape of the bow 9. This notch shape insures that the bow will be held by this complementary mount shape in a vertical position against the backing 1. If desired the exposed front edge lip 17 of the notch 15 can be raised slightly to insure the mounted bow will not slide out from its cradled position. Normally this desired mounting and backing configuration is sufficient to store, hold and permit the displaying of most conventional bows whether they be long bows, compound bows, etc.

Variation in the bow's arcuate curvature can easily be taken care of by first loosen the pivotal screw and then tightening it when the two mounts notches 15 engages a sufficient amount of the bow's surface to vertically support it.

One embodiment of the invention used 2.5 inch wide wooden mounts screwed into a 0.75 thick wooden stained and sealed wooden backing 1 that was 36 inches long by 12 inches high.

In the rare event the two spaced bow support mounts are insufficient to accommodate a given bow due to its unusual size, shape or weight an additional lower mount fixed to the backing 1 located midway between the two mounts 5 and 7 can be used. This third fixed mount could be in the form of a peg into and extending from the front surface of backing 1. Additionally, again in the usual rare case, it is found the two spaced mounts by themselves cannot properly vertically support the cradled bow, an upper strap or other fastener attached to extending from the backing 1 and engaging the bow's string 9 at approximately its mid length may be added for additional support. Neither of these two additional supports are contemplated for the vast majority of conventional bows.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. The combination of a bow display and storage device and a bow comprising:

a stringed bow having a taut string portion and a solid portion bow adapted to propel an arrow through the air;

a planar support backing adapted to be vertically supported; and two spaced bow engaging support mounts each pivotally joined to said planar backing and extending outwardly therefrom and adapted to engage the bow's solid surface portion along its upper mount length to vertically support and display the bow against the backing.

2. The combination as claimed in claim 1, wherein said support mounts are pivotally joined to said support backing by members which extend through the backing into the mounts.

3. The combination as claimed in claim 1, wherein said mounts have upper recessed surfaces in their bow engaging surfaces to engage and cradle the bow surface.

4. The combination as claimed in claim 3, wherein said recesses in the support mounts have raised front surfaces lips to restrict the outwardly movement of an engaged bow.

* * * * *